US011808086B2

(12) United States Patent
Jansson et al.

(10) Patent No.: US 11,808,086 B2
(45) Date of Patent: Nov. 7, 2023

(54) DRILL STRING ROD

(71) Applicant: SANDVIK MINING AND CONSTRUCTION TOOLS AB, Sandviken (SE)

(72) Inventors: Tomas Jansson, Sandviken (SE); Mattias Pettersson, Sandviken (SE)

(73) Assignee: Sandvik Mining and Construction Tools AB, Sandviken (SE)

( * ) Notice: Subject to any disclaimer, the term of this patent is extended or adjusted under 35 U.S.C. 154(b) by 0 days.

(21) Appl. No.: 17/440,421

(22) PCT Filed: Mar. 5, 2020

(86) PCT No.: PCT/EP2020/055758
§ 371 (c)(1),
(2) Date: Sep. 17, 2021

(87) PCT Pub. No.: WO2020/187575
PCT Pub. Date: Sep. 24, 2020

(65) Prior Publication Data

US 2022/0154538 A1 May 19, 2022

(51) Int. Cl.
*E21B 17/042* (2006.01)

(52) U.S. Cl.
CPC ..... *E21B 17/0426* (2013.01)

(58) Field of Classification Search
CPC .... E21B 17/042; E21B 17/04; E21B 17/0426; E21B 17/0423; E21B 17/043; F16L 15/00
See application file for complete search history.

(56) References Cited

U.S. PATENT DOCUMENTS 4,146,060 A * 3/1979 Garrett ..... B23P 11/00 138/146
4,332,502 A * 6/1982 Wormald ..... E21B 17/0426 403/343

(Continued)

FOREIGN PATENT DOCUMENTS

CN 107002467 A 8/2017
DE 2800887 A1 7/1978

(Continued)

*Primary Examiner* — Kipp C Wallace
(74) *Attorney, Agent, or Firm* — Corinne R. Gorski

(57) ABSTRACT

A drill string rod includes an elongate central rod portion. The central rod portion has a hollow-cylindrical shape with an inner first diameter ($d_{rod}$) and an outer second diameter ($D_{rod}$). The male end includes a spigot having a base projecting axially from a shoulder that axially separates the spigot and the central rod portion. The female end has a sleeve portion that fits to the spigot. An inner thread of the sleeve portion is attachable to an outer thread of the base of the spigot of a further drill string rod. In a radial plane to the longitudinal axis of the drill string rod, the base of the spigot is defined by an outer third diameter ($D_{spigot}$) and an inner fourth diameter ($d_{spigot}$) and the sleeve portion is defined by an outer fifth diameter ($D_{sleeve}$) and an inner sixth diameter ($d_{sleeve}$), wherein the second diameter ($D_{rod}$) is >60 mm.

8 Claims, 2 Drawing Sheets

(56) References Cited

U.S. PATENT DOCUMENTS

| | | | | |
|---|---|---|---|---|
| 4,398,756 | A | 8/1983 | Duret et al. | |
| 4,687,368 | A * | 8/1987 | Eklof | F16L 15/006 285/334 |
| 5,236,018 | A * | 8/1993 | Kobayashi | B29C 53/585 138/139 |
| 6,244,631 | B1 * | 6/2001 | Payne | E21B 17/042 285/333 |
| 6,767,156 | B1 | 7/2004 | Larsson | |
| 2005/0067195 | A1 * | 3/2005 | Linden | E21B 17/0426 175/320 |
| 2005/0189147 | A1 * | 9/2005 | Williamson | E21B 17/042 175/320 |
| 2010/0308577 | A1 * | 12/2010 | Chin | E21B 17/042 285/333 |
| 2016/0208561 | A1 * | 7/2016 | Ahola | E21B 17/0426 |
| 2016/0222737 | A1 * | 8/2016 | Rosen | E21B 17/042 |
| 2018/0135782 | A1 * | 5/2018 | Ahola | E21B 17/042 |
| 2019/0257970 | A1 * | 8/2019 | Fang | G01V 1/44 |
| 2020/0173584 | A1 * | 6/2020 | Biggerstaff | E21B 19/16 |
| 2020/0248509 | A1 * | 8/2020 | Sugino | E21B 17/042 |
| 2021/0254414 | A1 * | 8/2021 | Briane | F16L 15/001 |
| 2022/0290784 | A1 * | 9/2022 | Cordero | F16L 15/002 |

FOREIGN PATENT DOCUMENTS

| | | | |
|---|---|---|---|
| EP | 2845992 | B1 | 3/2015 |
| RU | 2204683 | C2 | 5/2003 |
| WO | 0065192 | A1 | 11/2000 |
| WO | 2015032657 | A1 | 3/2015 |
| WO | 2015032659 | A1 | 3/2015 |

* cited by examiner

DRILL STRING ROD

RELATED APPLICATION DATA

This application is a § 371 National Stage Application of PCT International Application No. PCT/EP2020/055758 filed Mar. 5, 2020 claiming priority to EP 19163477.3 filed Mar. 18, 2019.

TECHNICAL FIELD

The present invention relates to drill string rods for use with drill bits for percussion rock drilling. Specifically, the invention relates to improving the reliability and longevity of such drill string rods.

BACKGROUND

Percussion drilling is used to create a long borehole via a plurality of elongate drill string rods coupled together end-to-end by interconnected male and female threaded ends. The well-established technique breaks rock by hammering impacts transferred from a rock drill bit, mounted at one end of the drill string, to the rock at the bottom of the borehole. Typically, the energy required to break the rock is generated by a hydraulically driven piston that contacts the end of the drill string (via a shank adaptor) to create a stress (or shock) wave that propagates through the drill string and ultimately to the rock. Conventional male and female threaded couplings are described in U.S. Pat. Nos. 4,332,502; 4,398,756; 4,687,368 and DE 2800887.

The male and female threaded ends of neighboring drill rods are coupled to create the drill string and the joint is typically subjected to large forces during drilling. These forces fatigue the coupling and lead to wear and breakage within the threaded portion of the joint. Typically, it is the threaded male spigot that is damaged and determines the operational lifetime of the coupling. U.S. Pat. No. 6,767,156 discloses a threaded joint between two percussive drill rods having conical guiding surfaces provided at the leading axial ends of the male and female portions in an attempt to achieve a secure coupling and prevent damage to the threads.

EP2845992B1 by the present applicant aims to mitigate the above-mentioned drawbacks.

Modern rock drilling increasingly demands drilling of larger holes and therefore a demand exists for provision of drill strings capable of handling larger drill bits, such as drill bits with a diameter of 130 mm and larger. Conventional drill string rods are too weak to carry larger drill bits and it has shown that merely up-scaling conventional drill string rods is not an option since they tend to crack in the spigot or in the sleeve portion rather than permitting use until the threads of the spigot/sleeve portion are worn out.

Hence, there is a need for a large-size drill string rod with improved reliability and longevity, still allowing for efficient flushing of drill cuttings.

SUMMARY

An object of the invention is to provide a drill string rod enabling use of larger-than-normal percussion drill bits with improved reliability and longevity of the drill string rods. The drill string rod is to form part of an assembly of connected such drill string rods. The drill string rod comprises an elongate central rod portion extending axially between a male end and a female end. The central rod portion is hollow-cylindrical defined by an inner first diameter ($d_{rod}$) and an outer second diameter ($D_{rod}$). The male end comprises a spigot, wherein the spigot comprises a base projecting axially from a shoulder that axially separates the spigot and the central rod portion. The female end comprises a sleeve portion configured to fit to the spigot. Also, the base is provided with an outer thread and the sleeve portion is provided with an inner thread, wherein the inner thread corresponds to the outer thread such that the inner thread of the sleeve portion is attachable to the outer thread of the base of the spigot of a further drill string rod of the assembly. In a radial plane to the longitudinal axis of the drill string rod, the base of the spigot is defined by an outer third diameter ($D_{spigot}$) and an inner fourth diameter ($d_{spigot}$) and the sleeve portion is defined by an outer fifth diameter ($D_{sleeve}$) and an inner sixth diameter ($d_{sleeve}$). The present invention is limited to drill string rods with an outer second diameter ($D_{rod}$) larger than 60 mm, thus being suitable for use with larger and heavier percussion drill bits. $C_{sleeve}$ and $C_{spigot}$ are related to the diameters of the drill string rod as defined by the following formulas:

$$C_{sleeve} = \frac{D_{rod} \cdot (D_{sleeve}^4 - d_{sleeve}^4)}{D_{sleeve} \cdot (D_{rod}^4 - d_{rod}^4)}$$

$$C_{spigot} = \frac{D_{rod} \cdot (D_{spigot}^4 - d_{spigot}^4)}{D_{spigot} \cdot (D_{rod}^4 - d_{rod}^4)}$$

$C_{sleeve}$ should be larger than 2.31 or $C_{spigot}$ should be larger than >0.68.

Drill string rods and their use are known in the art. However, drill string rods with an outer diameter $D_{rod}$ larger than 60 mm are not common. These larger drill string rods are very robust and suitable for larger rock drill bits. While normal drill string rods with rod diameter smaller than 60 mm tend not to have material failures but to be discarded and replaced only when the threads of the spigot and sleeve portion are worn out, larger diameter drill rods tend to break by cracks in the sleeve portion or spigot. Mitigating formation of cracks merely by increasing the thickness of goods is generally not successful, since it would either weaken some other part of the drill rod or reduce available space for flushing fluid and drill cuttings to move through. The skilled person understands that the diameters cannot be chosen freely. For example, the outer diameter of the spigot is naturally limited by the inner diameter of the sleeve portion. Also, the outer diameter of the sleeve portion is typically limited by the size of the bore drilled and the requirement for enough space for the flushing away of drill cuttings past the sleeve portion between the sleeve portion and the inner wall of the bore. Similarly, the inner diameter of the spigot limits the rate at which flushing fluid can be pumped through the drill string rod, and thus should not be too small. The design of these large-diameter drill string rods is clearly a difficult balancing act and the present invention guides the skilled person to the selection of a combination of parameters enabling reduced risk of material failures in the drill string rod with sustained flushing performance. To solve this problem has shown to be more difficult than it would seem.

The inventors of the present invention have realized that the drill string rod failures are due to the combination of the increased stiffness of the central rod portion and forced bending of the drill string induced by harder layers or cracks in the rock. The bending of the drill string rod happens while the rod is rotating and thereby creates both additional stress due to bending, and fatigue due to the constant change of bending axis caused by the rotation of the rod in the bore whilst in its bent condition.

The proposed solution is to dimension the spigot and the sleeve portion such that the calculated maximum bending stress in the spigot and the sleeve portion respectively is related to the calculated maximum bending stress in the central rod portion. However, the inventors have realized that the calculated maximum stresses of the sleeve portion and the spigot respectively should not be equal to the calculated maximum bending stress of the central rod portion but rather relate to the calculated maximum bending stress of the central rod portion multiplied by the factor $C_{sleeve}$ or $C_{spigot}$, respectively, in order to account for commonly occurring differences in strength occurring for example due to local material variations likely occurring due to uneven hardening and/or machining at manufacturing of the drill string rods.

In some embodiments, $C_{sleeve}$ >2.31 and $C_{spigot}$ >0.68. This balance of the first, second, third, fourth, fifth, and sixth diameters involved provide for high reliability and longevity of the drill string rod.

In some embodiments, the base of the spigot is conical.

In some embodiments, the base of the spigot is cylindrical.

In some embodiments, the first diameter ($d_{rod}$) is 50 mm, wherein the second diameter ($D_{rod}$) is 80.5 mm, wherein the third diameter is ($D_{spigot}$) is 82 mm, wherein the fourth diameter ($d_{spigot}$) is 50 mm, wherein the firth diameter is ($D_{sleeve}$) is 120 mm and wherein the sixth diameter ($d_{sleeve}$) is 91.2 mm.

In some embodiments, the drill string rod is suitable for use with a drill bit having an outer seventh diameter ($D_{hole}$), wherein the fifth diameter is <0.90* the seventh diameter ($D_{hole}$).

A further aspect relates to a system comprising a plurality of drill string rods according to the first aspect described above.

In some embodiments, the drill string rods of the system are of the type mentioned above which are suitable for use with a drill bit having an outer seventh diameter ($D_{hole}$), wherein the fifth diameter is <0.90* the seventh diameter ($D_{hole}$), and wherein the system further comprises the drill bit.

The difference in diameter between the hole and the outer diameter of the sleeve portion enables efficient flushing of drill cuttings past the sleeve portion, whilst providing robust drill string rods capable of handling the forces involved.

In some embodiments, the seventh diameter is >130 mm. Drill string rods having a second diameter >60 mm are suitable for such large-diameter drill bits, wherein the specified constraints of the involved diameters of the drill string rods governed by $C_{sleeve}$ and $C_{spigot}$ provide for a robust drilling system.

DETAILED DESCRIPTION

Figure 1:
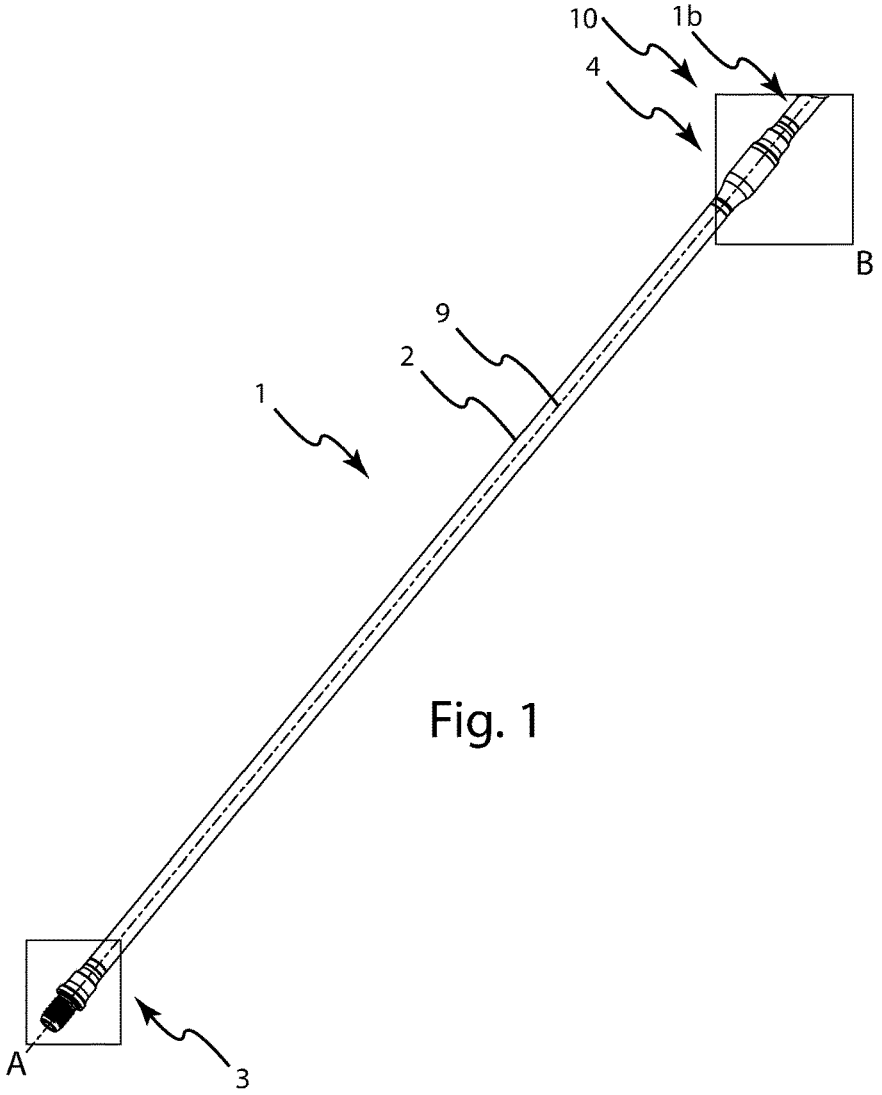
FIG. 1 shows a perspective view of two identical connected drill string rods.
Figure 2:
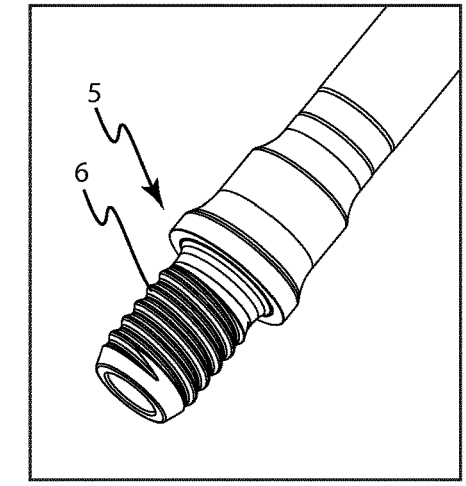
FIG. 2 shows an enlarged perspective view A of the male end of the drill string rod as indicated in FIG. 1.
Figure 3:
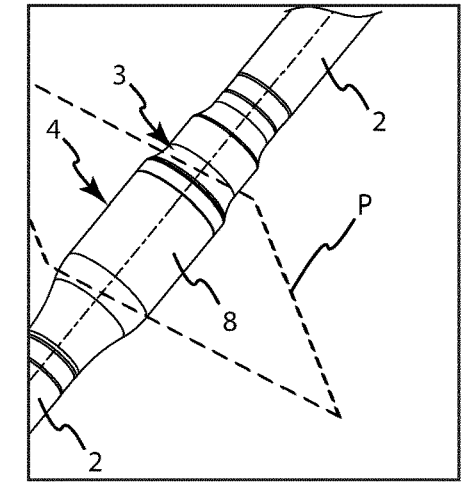
FIG. 3 shows an enlarged perspective view B of the female end of the drill string rod as indicated in FIG. 1, which is connected to the male end of the other drill string rod.
Figure 4:
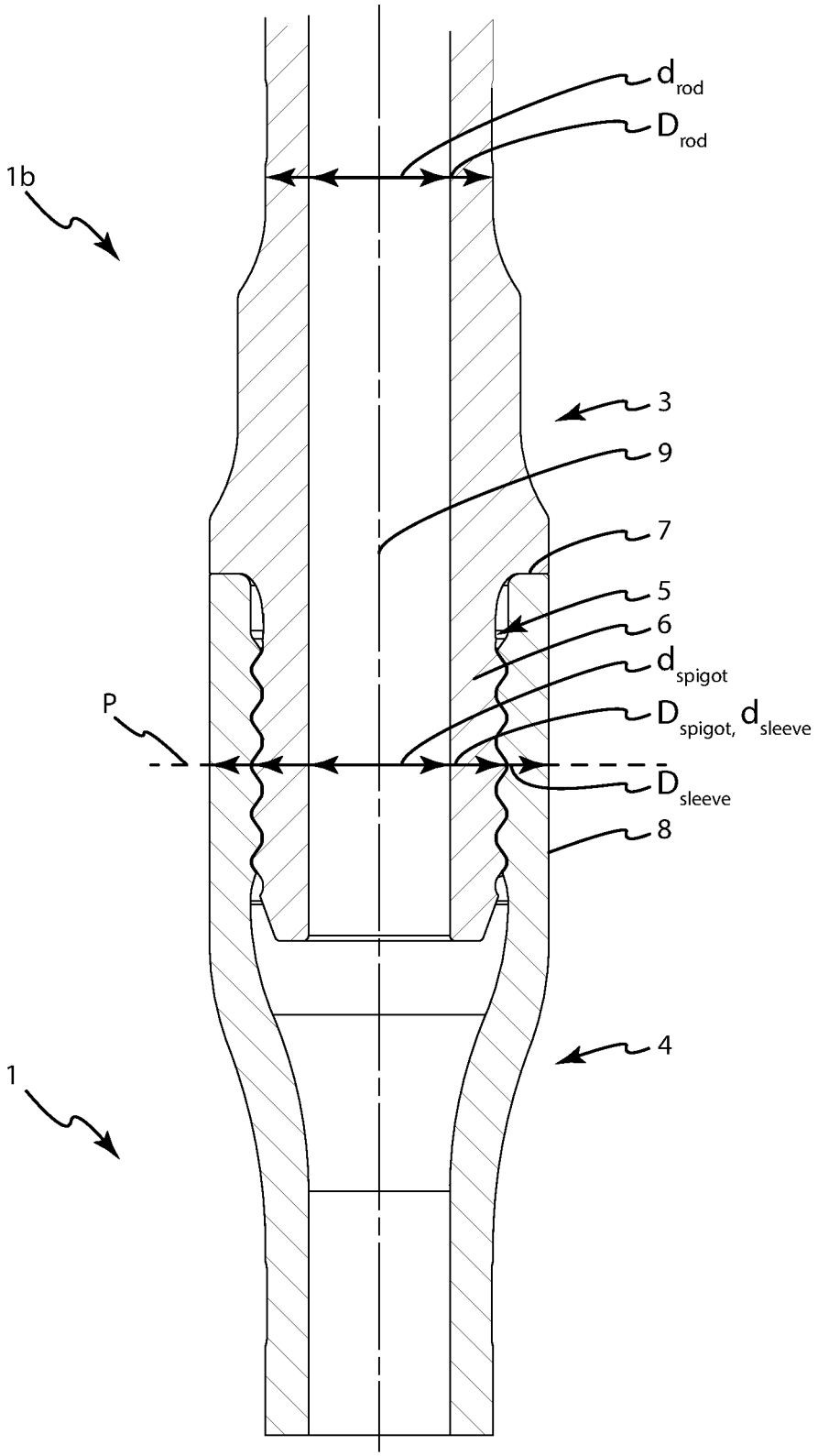
FIG. 4 shows a cross-sectional side view of the sleeve portion and the spigot of the two connected drill string rods also shown in FIG. 1, said cross-section taken in a plane through the longitudinal central axis of the drill string rod.

A first embodiment of the invention is shown in FIGS. 1-4. As shown in the figures, a plurality of identical drill string rods 1, 1*b* are connectable to form a system/assembly 10. The drill string rod 1 comprises an elongate central rod portion 2 extending axially between a male end 3 and a female end 4. As shown in FIG. 4, the central rod portion 2 is hollow-cylindrical defined by an inner first diameter $d_{rod}$ and an outer second diameter $D_{rod}$. The male end 3 comprises a spigot 5, and the spigot 5 comprises a base 6

$$C_{sleeve} = \frac{D_{rod} \cdot (D_{sleeve}^4 - d_{sleeve}^4)}{D_{sleeve} \cdot (D_{rod}^4 - d_{rod}^4)}$$

projecting axially from a shoulder 7 that axially separates the spigot 5 and the central rod portion 2. The female end 4 comprises a sleeve/sleeve portion 8 configured to fit to the spigot 5. The base 6 is provided with an outer thread and the sleeve portion 8 is provided with an inner thread, wherein the inner thread corresponds to the outer thread such that the inner thread of the sleeve portion 8 is attachable to the outer thread of the base 6 of the spigot 5 of a further drill string rod of the assembly. In a radial plane P to the longitudinal axis of the drill string rod the base 6 of the spigot 5 is defined by an outer third diameter ($D_{spigot}$) and an inner fourth diameter ($d_{spigot}$) and the sleeve portion 8 is defined by an outer fifth diameter ($D_{sleeve}$) and an inner sixth diameter ($d_{sleeve}$). It should be noted that in FIG. 4, $D_{spigot}$ and $d_{sleeve}$ are both mentioned in connection with the same arrow although in reality the diameters are slightly different with $d_{sleeve}$ being larger than $D_{spigot}$. The scale of the drawing is such that the difference in diameter cannot be shown in FIG. 4 using separate arrows. Although the diameters may vary along the length of the spigot and the sleeve portion respectively, the radial plane P which by necessity runs through both the spigot and the sleeve portion, is used to define the relationship between the diameters in an unambiguous way.

$$C_{spigot} = \frac{D_{rod} \cdot (D_{spigot}^4 - d_{spigot}^4)}{D_{spigot} \cdot (D_{rod}^4 - d_{rod}^4)}$$

The present invention is limited to drill string rods with an outer diameter larger than 60 mm, thus being suitable for use with heavier percussion drill bits, such as drill bits larger with larger diameter than 130 mm. Hence, the second diameter ($D_{rod}$) is >60 mm. $C_{sleeve}$ and $C_{spigot}$ are derivable from/related to the diameters of the drill string rod using the following formulas:

These formulas stem from the calculation of section modulus for a known hollow-cylindrical beams/bodies which provide a good approximation of the present involved cross-sectional shapes. Specifically, the section modulus equations for hollow-cylindrical cross-sections is:

$$S = \frac{\pi(r_2^4 - r_1^4)}{4r_2} = \frac{\pi(d_2^4 - d_1^4)}{32d_2}$$

Our assumption is that:

$$S_{spigot} = C_{spigot} * S_{rod} \rightarrow \frac{\pi(D_{spigot}^4 - d_{spigot}^4)}{32 * D_{spigot}} = \frac{\pi(D_{rod}^4 - d_{rod}^4)}{32 * Drod} * C_{spigot} \rightarrow$$

$$\rightarrow C_{spigot} = \frac{D_{rod} \cdot (D_{spigot}^4 - d_{spigot}^4)}{D_{spigot} \cdot (D_{rod}^4 - d_{rod}^4)}$$

And similarly that $S_{sleeve}=C_{sleeve}*S_{rod}\rightarrow$ $$\rightarrow C_{sleeve} = \frac{D_{rod} \cdot (D_{sleeve}^4 - d_{sleeve}^4)}{D_{sleeve} \cdot (D_{rod}^4 - d_{rod}^4)}$$

In this embodiment, the first diameter $d_{rod}$ is 50 mm, wherein the second diameter $D_{rod}$ is 80.5 mm, wherein the third diameter $D_{spigot}$ is 82 mm, wherein the fourth diameter $d_{spigot}$ is 50 mm, wherein the fifth diameter $D_{sleeve}$ is 120 mm and wherein the sixth diameter $d_{sleeve}$ is 91.2 mm.

This embodiment of the drill string rod 1, 1*b* is suitable for use with a drill bit (not illustrated) having a specified diameter (the diameter not including the drilling inserts) of 140, 152, 165, 172 or 178 mm. The actual diameter of the holes drilled is slightly larger since the drill bits protrude radially. The first through sixth diameters may in other embodiments be chosen differently, as long as the second diameter $D_{rod}$, which defines the outer diameter of the central rod portion 2, fulfills the above constraint of being at least 60 mm, and the other diameters fulfil the constraints that $C_{sleeve}$ is larger than 2.31 or that $C_{spigot}$ is larger than 0.68. Preferably, $C_{sleeve}$ is larger than 2.31 and $C_{spigot}$ is larger than 0.68.

The drill string rods are made of a suitable material, such as steel, and are hardened as needed.

The drill string rod 1, 1*b* is dimensioned based on the size of the drill bit for which it is to be used. However, care must be taken to provide enough space around the sleeve portion 8 for drill cuttings to be flushed past the sleeve portion 8. To this effect, the drill string rod 1, 1*b* may in some embodiments be suitable for use with a drill bit having an outer seventh diameter $D_{hole}$, wherein the outer fifth diameter $D_{sleeve}$ of the sleeve portion 8 is less than 0.90* the seventh diameter $D_{hole}$.

A plurality of identical drill string rods 1, 1*b* may be provided together as part of a system/assembly 10 of the drill string rods 1, 1*b*. The system 10 may alternatively comprise a drill bit. The drill string rods 1, 1*b* of the system may have an outer seventh diameter $D_{hole}$, wherein the fifth diameter is <0.90* the seventh diameter $D_{hole}$, and wherein the system further comprises the drill bit.

The difference in diameter between the hole and the outer fifth diameter $D_{sleeve}$ of the sleeve portion 8 enables efficient flushing of drill cuttings past the sleeve portion 8, whilst providing robust drill string rods 1, 1*b* capable of handling the forces involved.

In some embodiments, the seventh diameter $D_{hole}$ may be 130 mm or greater. As mentioned above, the drill string rods of the present invention all have a second diameter greater than 60 mm and are suitable for such large-diameter drill bits. The specified constraints of the involved diameters given by $C_{sleeve}$ and $C_{spigot}$ provide for a robust system/assembly 10.

The invention claimed is:

1. A drill string rod arranged to form part of an assembly of connected drill string rods, the drill string rod comprising: an elongate central rod portion extending axially between a male end and a female end, wherein the central rod portion has a hollow-cylindrical shape defined by an inner first diameter ($d_{rod}$) and an outer second diameter ($D_{rod}$), wherein the male end includes a spigot, the spigot having a base projecting axially from a shoulder that axially separates the spigot and the central rod portion, wherein the female end includes a sleeve portion configured to fit to the spigot, wherein the base is provided with an outer thread and wherein the sleeve portion is provided with an inner thread, wherein the inner thread corresponds to the outer thread such that the inner thread of the sleeve portion is attachable to the outer thread of the base of the spigot of a further drill string rod of the assembly, a connection between the inner thread of the sleeve portion and the outer thread of the base being cylindrical, wherein, in a radial plane to the longitudinal axis of the drill string rod, the base of the spigot is defined by an outer third diameter ($D_{spigot}$) and an inner fourth diameter ($d_{spigot}$) and the sleeve portion is defined by an outer fifth diameter ($D_{sleeve}$) and an inner sixth diameter ($d_{sleeve}$), wherein the second diameter ($D_{rod}$) >60 mm, wherein a relationship between outer diameters of the sleeve ($C_{sleeve}$) and a relationship between outer diameters of the spigot ($C_{spigot}$) are defined as:

$$C_{sleeve} = \frac{D_{rod} \cdot (D_{sleeve}^4 - d_{sleeve}^4)}{D_{sleeve} \cdot (D_{rod}^4 - d_{rod}^4)}$$

$$C_{spigot} = \frac{D_{rod} \cdot (D_{spigot}^4 - d_{spigot}^4)}{D_{spigot} \cdot (D_{rod}^4 - d_{rod}^4)}$$

and wherein $C_{sleeve}$ >2.31 or $C_{spigot}$ >0.68, wherein a radial plane P extends through both the spigot and the sleeve portion along an entire length of the connection and defines the relationship between the outer diameters of the sleeve ($C_{sleeve}$) and the relationship between outer diameters of the spigot ($C_{spigot}$).

2. The drill string rod according to claim 1, wherein $C_{sleeve}$ >2.31 and $C_{spigot}$ >0.68.

3. The drill string rod according to claim 1, wherein the base of the spigot is conical.

4. The drill string rod according to claim 1, wherein the first diameter ($d_{rod}$) is 50 mm, wherein the second diameter ($D_{rod}$) is 80.5 mm, wherein the third diameter ($D_{spigot}$) is 82 mm, wherein the fourth diameter ($d_{spigot}$) is 50 mm, wherein the fifth diameter ($D_{sleeve}$) is 120 mm and wherein the sixth diameter ($d_{sleeve}$) is 91.2 mm.

5. The drill string rod according claim 1, wherein the drill string rod is arranged for use with a drill bit having an outer seventh diameter ($D_{hole}$), wherein the fifth diameter ($D_{sleeve}$) is <0.90* the seventh diameter ($D_{hole}$).

6. A system comprising a plurality of drill string rods according to claim 1.

7. The system according to claim 6, wherein said system includes a drill bit, the drill string rod being arranged for use with the drill bit, the drill bit having an outer seventh diameter ($D_{hole}$), wherein the fifth diameter ($D_{sleeve}$) is <0.90* the seventh diameter ($D_{hole}$).

8. The system according to claim 7, wherein the seventh diameter ($D_{hole}$) is 130 mm or larger.

* * * * *